US007928951B2

(12) United States Patent
Fujita

(10) Patent No.: US 7,928,951 B2
(45) Date of Patent: Apr. 19, 2011

(54) ELECTRO-OPTICAL DEVICE, METHOD OF DRIVING ELECTRO-OPTICAL DEVICE, AND ELECTRONIC APPARATUS

(75) Inventor: Shin Fujita, Suwa (JP)

(73) Assignee: Sony Corporation, Tokyo (JP)

( * ) Notice: Subject to any disclaimer, the term of this patent is extended or adjusted under 35 U.S.C. 154(b) by 979 days.

(21) Appl. No.: 11/436,032

(22) Filed: May 18, 2006

(65) Prior Publication Data

US 2006/0279504 A1 Dec. 14, 2006

(30) Foreign Application Priority Data

Jun. 2, 2005 (JP) ..... 2005-162214
Mar. 20, 2006 (JP) ..... 2006-076307

(51) Int. Cl.
*G09G 3/36* (2006.01)
*G09G 3/20* (2006.01)

(52) U.S. Cl. ..... 345/98; 345/55

(58) Field of Classification Search ..... 345/55, 345/98

See application file for complete search history.

(56) References Cited

U.S. PATENT DOCUMENTS

| | | | | |
|---|---|---|---|---|
| 4,338,598 | A * | 7/1982 | Ohba et al. | 345/76 |
| 5,657,039 | A * | 8/1997 | Mizukata et al. | 345/95 |
| 5,892,493 | A | 4/1999 | Enami et al. | |
| 6,791,523 | B2 * | 9/2004 | Fujita et al. | 345/92 |
| 6,795,047 | B2 | 9/2004 | Kudo et al. | |
| 7,084,852 | B2 | 8/2006 | Nishi et al. | |
| 7,088,330 | B2 * | 8/2006 | Nagata et al. | 345/100 |
| 7,098,885 | B2 | 8/2006 | Kumada et al. | |
| 7,355,596 | B2 | 4/2008 | Kudo et al. | |
| 2001/0015715 | A1 * | 8/2001 | Hebiguchi et al. | 345/92 |
| 2002/0101398 | A1 * | 8/2002 | Fujita | 345/90 |
| 2002/0180721 | A1 * | 12/2002 | Kimura et al. | 345/211 |
| 2003/0151572 | A1 * | 8/2003 | Kumada et al. | 345/87 |
| 2005/0264518 | A1 * | 12/2005 | Nojiri et al. | 345/103 |
| 2006/0232542 | A1 | 10/2006 | Nishi et al. | |

FOREIGN PATENT DOCUMENTS

| | | | |
|---|---|---|---|
| JP | A-9-5704 | | 1/1997 |
| JP | A-2002-41003 | | 2/2002 |
| JP | A-2002-244622 | | 8/2002 |
| JP | 2004-191536 | * | 12/2002 |
| JP | 2004191536 | * | 12/2002 |
| JP | 2004-354758 | * | 5/2003 |
| JP | 2004354758 | * | 5/2003 |
| JP | A-2003-271105 | | 9/2003 |
| JP | A-2003-302951 | | 10/2003 |

(Continued)

*Primary Examiner* — Bipin Shalwala
*Assistant Examiner* — Benyam Ketema
(74) *Attorney, Agent, or Firm* — K&L Gates LLP

(57) ABSTRACT

An electro-optical device includes: a common line driving circuit; a data line driving circuit; a scanning line driving circuit; and an equalizing circuit which connects/disconnects a plurality of data lines to/from a plurality of common lines and equalizes the data lines with the common lines. The common line driving circuit supplies to the common lines a driving signal having a first or second potential. The data line driving circuit supplies image signals to the data lines at a potential higher than the first potential when the potential of a common electrode is the first potential, and supplies the image signals to the data lines at a potential lower than the second potential when the potential of the common electrode is the second potential. The scanning line driving circuit supplies, to a plurality of scanning lines, control signals for turning on or off a plurality of switching elements.

10 Claims, 11 Drawing Sheets

FOREIGN PATENT DOCUMENTS

| | | |
|---|---|---|
| JP | A 2004-191536 | 7/2004 |
| JP | A 2004-354758 | 12/2004 |
| JP | A-2005-70540 | 3/2005 |
| KR | 0245965 B1 | 3/2000 |

* cited by examiner

Conventional Art

ELECTRO-OPTICAL DEVICE, METHOD OF DRIVING ELECTRO-OPTICAL DEVICE, AND ELECTRONIC APPARATUS

BACKGROUND

1. Technical Field

The present invention relates to an electro-optical device, to a method of driving an electro-optical device, and to an electronic apparatus.

2. Related Art

Electro-optical devices, such as liquid crystal devices for displaying images using liquid crystal have been known in recent years. For example, the electro-optical device has the following structure.

FIG. 11 is a plan view illustrating an electro-optical device 1 according to the related art.

The electro-optical device 1 includes a liquid crystal panel AA, a scanning line driving circuit 101, a data line driving circuit 102, and a common line driving circuit 103.

The liquid crystal panel AA includes an element substrate 100 having thin film transistors (hereinafter, referred to as TFTs) 151, serving as switching elements, arranged in a matrix thereon, a counter substrate arranged opposite to the element substrate 100, and liquid crystal interposed between the element substrate 100 and the counter substrate.

The scanning line driving circuit 101 and the data line driving circuit 102 are formed on the element substrate 100 of the liquid crystal panel AA.

The element substrate 100 has a plurality of scanning lines 110 which are provided at predetermined intervals, a plurality of data lines 120 which are provided at predetermined intervals so as to be substantially orthogonal to the scanning lines 110, and a plurality of common lines 130 which are alternately provided so as to be substantially parallel to the plurality of scanning lines 110 formed thereon.

Further, pixel circuits 150 are provided so as to correspond to intersections of the scanning lines 110 and the data lines 120. Each of the pixel circuits 150 is composed of the TFT 151, a pixel electrode 155, and a storage capacitor 153 having one end connected to the pixel electrode 155 and the other end connected to the common line 130.

In each pixel circuit, a gate of the TFT 151 is connected to the scanning line 110, and a source of the TFT 151 is connected to the data line 120. In addition, a drain of the TFT 151 is connected to the pixel electrode 155 and the storage capacitor 153. In this way, the TFT 151 connects or disconnects the data line 120 to or from the pixel electrode 155 and the storage capacitor 153, in response to a control signal transmitted through the scanning line 110.

The counter substrate includes a common electrode 156 arranged opposite to the pixel electrodes 155. The common electrode 156 is connected to the common lines 130 by opposite connecting portions 105 provided at four corners of the element substrate 100 and common wiring lines 106 for connecting these opposite connecting portions 105.

The common line driving circuit 103 supplies to the common lines 130 a control signal having a first potential or a second potential higher than the first potential.

The data line driving circuit 102 supplies image signals to the data lines 120 at a potential higher than the first potential when the potential of the common electrode 156 is the first potential, and supplies the image signals to the data lines 120 at a potential lower than the second potential when the potential of the common electrode 156 is the second potential.

The scanning line driving circuit 101 supplies control signals for turning on or off the TFTs 151 to the scanning lines 110.

In the electro-optical device 1, the common line driving circuit 103 inverts the potential of the common electrode 156 between the first potential and the second potential which is higher than the first potential (hereinafter, referred to as common inversion driving). When the potential of the common electrode 156 is the first potential, the data line driving circuit 102 supplies the image signals to the data lines 120 at a potential higher than the first potential (hereinafter, referred to as positive writing). When the potential of the common electrode 156 is the second potential, the data line driving circuit 102 supplies the image signals to the data lines 120 at a potential lower than the second potential (hereinafter, referred to as negative writing).

FIG. 12 is a timing chart of the electro-optical device 1 according to the related art at the time of positive writing. FIG. 13 is a timing chart of the electro-optical device 1 according to the related art at the time of negative writing. FIGS. 12 and 13 show a structure in which writing is performed at the same grayscale level. In FIGS. 12 and 13, characters VCOM indicate the potential of the common electrode 156, and characters SOURCE indicate the potential of the data line 120. In addition, characters GATE indicate the potential of the scanning line 110, and characters PIX indicate the potential of the pixel electrode 155.

As shown in FIG. 12, in the positive writing, first, the common line driving circuit 103 supplies a control signal for allowing the potential VCOM of the common electrode 156 to turn to a first potential VCL, and the scanning line driving circuit 101 supplies a control signal for allowing the potential GATE of the scanning lines 110 to turn to a potential VGH, thereby turning on TFTs 151.

Next, at a time t1, the data line driving circuit 102 supplies the image signals to raise the potential SOURCE of the data lines 120 from a potential VP1 to a potential VP5, causing the image signals to be written onto the pixel electrodes 155 and the storage capacitors 153 through the TFTs 151.

Next, at a time t2, the scanning line driving circuit 101 turns on the TFTs 151. Then, a difference between the first potential VCL of the common electrode 156 and the potential VP5 written onto the pixel electrodes 155 is applied to the liquid crystal, and is then held by the storage capacitors 153.

Subsequently, at a time t3, the common line driving circuit 130 raises the potential VCOM of the common electrode 156 from the first potential VCL to a second potential VCH. Then, the potential PIX of the pixel electrodes 155 rises up to a potential VP2 together with the potential of the common electrode 156, with a difference between the potential PIX of the pixel electrodes 155 and the potential VCOM of the common electrode 156 kept constant. At that time, the data lines 120 are disconnected from the pixel electrodes 155 by the TFTs 151, but are capacitively connected to the common lines 130, which causes the potential SOURCE of the data lines 120 to rise up to the potential VP2 which is equal to the potential PIX of the pixel electrodes 155.

Next, in the negative writing, as shown in FIG. 13, first, the common line driving circuit 103 supplies a control signal for allowing the potential VCOM of the common electrode 156 to turn to the second potential VCH, and the scanning line driving circuit 101 supplies a control signal for allowing the potential GATE of the scanning lines 110 to turn to the potential VGH, thereby turning on TFTs 151.

Next, at a time t5, the data line driving circuit 102 supplies the image signals to lower the potential SOURCE of the data lines 120 from the potential VP2 to a potential VP6, causing the image signals to be written onto the pixel electrodes 155 and the storage capacitors 153 through the TFTs 151.

Next, at a time t6, the scanning line driving circuit 101 turns off the TFTs 151. Then, a difference between the second potential VCH of the common electrode 156 and the potential VP6 written onto the pixel electrodes 155 is applied to the liquid crystal, and is then held by the storage capacitors 153.

Subsequently, at a time t7, the common line driving circuit 130 lowers the potential VCOM of the common electrode 156 from the second potential VCH to the first potential VCL. Then, the potential PIX of the pixel electrodes 155 is lowered to a potential VP1 together with the potential of the common electrode 156, with a difference between the potential PIX of the pixel electrodes 155 and the potential VCOM of the common electrode 156 kept constant. At that time, the data lines 120 are disconnected from the pixel electrodes 155 by the TFTs 151, but are capacitively connected to the common lines 130, causing the potential SOURCE of the data lines 120 to be lowered to the potential VP1 which is equal to the potential PIX of the pixel electrodes 155.

According to the electro-optical device 1, it is possible to prevent the liquid crystal screen of the liquid crystal panel AA from being burnt.

However, in the conventional electro-optical device 1, when the potential SOURCE of the data line 120 is raised from the potential VP1 to the potential VP5 and when the potential SOURCE of the data line 120 is lowered from the potential VP2 to the potential VP6, a large amount of power is consumed. In addition, it takes a long time to write the image signals onto the pixel electrodes 155.

Further, when the positive writing is performed, capacitive coupling occurs between the data line 120 and the common line 130. Therefore, when the potential VCOM of the common electrode 156 rises from the first potential VCL to the second potential VCH, the potential SOURCE of the data line 120 rises up to the potential VP2 which is equal to the potential PIX of the pixel electrode 155. On the other hand, when the negative writing is performed, capacitive coupling occurs between the data line 120 and the common line 130. Therefore, when the potential VCOM of the common electrode 156 is lowered from the second potential VCH to the first potential VCL, the potential SOURCE of the data line 120 is lowered to the potential VP1 which is equal to the potential PIX of the pixel electrode 155. As a result, an excessively high voltage is applied to the data line driving circuit 102, causing the data line driving circuit 102 to be damaged.

In view of the above-mentioned problems, there has been proposed an electro-optical device including a pre-charge circuit having a large capacitance (for example, see JP-A-2004-354758). In addition, there has been suggested an electro-optical device including a pre-charge circuit for supplying a driving voltage to the data lines (for example, see JP-A-2004-191536).

In the electro-optical device including the pre-charge circuit disclosed in JP-A-2004-354758, when the potential of the common electrode rises in the positive writing, a rise of the potential of the data line to a potential equal to the potential of the pixel electrode is prevented by moving charges between the data line and the pre-charge circuit having a large capacitance. On the other hand, when the potential of the common electrode is lowered in the negative writing, the lowering of the potential of the data line to a potential equal to the potential of the pixel electrode is prevented by moving charges between the data line and the pre-charge circuit having a large capacitance.

In this way, it is possible to prevent the potential of the data line from being raised or lowered without supplying the driving voltage to the data line, and thus to reduce power consumption. In addition, it is possible to prevent the data line driving circuit from being damaged.

In the electro-optical device including the pre-charge circuit disclosed in JP-A-2004-191536, before the potential of the common electrode is raised in the positive writing, the pre-charge circuit supplies the driving voltage to raise the potential of the data line up to a potential equal to the potential of the common electrode. In addition, before the potential of the common electrode is lowered in the negative writing, the pre-charge circuit supplies the driving voltage to lower the potential of the data line to the potential equal to the potential of the common electrode.

In this way, it is possible to reduce a difference in potential before and after the image signals are written by supplying the driving voltage and thus to shorten the time required for writing the image signals to the pixel electrodes.

However, in recent years, portable apparatuses, such as cellular phones provided with electro-optical devices, have come into widespread use. The electro-optical device has a problem in that power consumption increases with the progress of the functions thereof. Therefore, there is a strong demand for an electro-optical device capable of reducing power consumption. However, the electro-optical device disclosed in JP-A-2004-354758 does not sufficiently meet such a demand. In addition, in the electro-optical device disclosed in JP-A-2004-191536, power consumption is reduced when the image signals are written onto the data lines, but the pre-charge circuit consumes power. Therefore, it is difficult to reduce overall power consumption.

SUMMARY

An advantage of some aspects of the invention is that it provides an electro-optical device, a method of driving an electro-optical device, and an electronic apparatus capable of reducing power consumption.

According to an aspect of the invention, an electro-optical device includes: a first substrate which includes a plurality of scanning lines, a plurality of data lines that are provided so as to be substantially orthogonal to the plurality of scanning lines, a plurality of common lines that are alternately provided so as to be substantially parallel to the scanning lines, and a plurality of pixel circuits that are provided so as to correspond to intersections of the scanning lines and the data lines, each of the plurality of pixel circuits having a pixel electrode, a storage capacitor which has one end connected to the pixel electrode and the other end connected to the common line, and a switching element which connects or disconnects the data line to or from the pixel electrode and the storage capacitor, in response to a control signal transmitted through the scanning line; a second substrate which is provided opposite to the first substrate and has a common electrode connected to the common lines; an electro-optical material which is provided between the first substrate and the second substrate; a common line driving circuit which supplies, to the common lines, a driving signal having a first potential or a second potential higher than the first potential; a data line driving circuit which supplies image signals to the data lines at a potential higher than the first potential when the potential of the common electrode is the first potential, and supplies the image signals to the data lines at a potential lower than the second potential when the potential of the common electrode is the second potential; a scanning line driving circuit which supplies, to the scanning lines, control signals for turning on or off the switching elements; and an equalizing circuit which connects or disconnects the data lines to or from the common lines and equalizes the data lines with the common lines. In the electro-optical device, the common line driving circuit includes a driving signal supplying circuit which supplies the driving signal having the first potential or the second potential and a driving signal supplying switch which connects or disconnects the driving signal supplying circuit to or from the common lines.

According to this aspect of the invention, positive writing is performed as follows.

First, the common line driving circuit changes the potential of the common electrode to the first potential, and the scanning line driving circuit supplies the control signal to the scanning lines, thereby turning on the switching elements. Then, the data line driving circuit supplies the image signals to the data lines to write the image signals onto the pixel electrodes and the storage capacitors through the switching elements. Subsequently, the scanning line driving circuit turns on the switching elements. Then, a difference between the first potential of the common electrode and the potential written onto the pixel electrodes is applied to the liquid crystal and is then held by the storage capacitors.

Next, the common line driving circuit raises the potential of the common electrode from the first potential to the second potential. Then, the potential of the pixel electrodes is raised together with the potential of the common electrode, with a difference between the potential of the pixel electrodes and the potential of the common electrode kept constant. At that time, the data lines are disconnected from the pixel electrodes by the switching elements, but are capacitively connected to the common lines. Thus, the potential of the data lines rises to a potential equal to the potential of the pixel electrodes.

The common line driving circuit includes the driving signal supplying circuit and the driving signal supplying switch. The driving signal supplying switch is temporarily turned off, and the equalizing circuit connects the data lines and the common lines. Then, the movement of charges occur between the data lines and the common electrode through the common lines, without the supply of the driving voltage from the driving signal supplying circuit, which causes the potential of the data lines to be substantially equal to the potential of the common electrode, not the pixel electrodes.

According to this aspect of the invention, negative writing is performed as follows.

First, the common line driving circuit changes the potential of the common electrode to the second potential, and the scanning line driving circuit supplies the control signal to the scanning lines, thereby turning on the switching elements. Then, the data line driving circuit supplies the image signals to the data lines to write the image signals onto the pixel electrodes and the storage capacitors through the switching elements. Subsequently, the scanning line driving circuit turns on the switching elements. Then, a difference between the second potential of the common electrode and the potential written onto the pixel electrodes is applied to the liquid crystal and is then held by the storage capacitors.

Next, the common line driving circuit lowers the potential of the common electrode from the second potential to the first potential. Then, the potential of the pixel electrodes is lowered together with the potential of the common electrode, with the difference between the potential of the pixel electrodes and the potential of the common electrode kept constant. At that time, the data lines are disconnected from the pixel electrodes by the switching elements, but are capacitively connected to the common lines. Thus, the potential of the data lines is lowered to a potential equal to the potential of the pixel electrodes.

The common line driving circuit includes the driving signal supplying circuit and the driving signal supplying switch. The driving signal supplying switch is temporarily turned off, and the equalizer function circuit connects the data lines and the common lines. Then, the movement of charges occurs between the data lines and the common electrode through the common lines, without the supply of the driving voltage from the driving signal supplying circuit, which causes the potential of the data lines to be substantially equal to the potential of the common electrode, not the pixel electrodes.

As described above, when the driving signal supplying switch is temporarily turned off, the movement of charges occurs between the data lines and the common electrode, without the supply of the driving voltage from the driving signal supplying circuit, which makes it possible to change the potential of the common line or the data lines by using the charges and thus to reduce power consumption.

Further, the potential of the data lines is changed in an optimal direction to write the next image signals, and the potential of the common electrode is also changed in an optimal direction for the next inverting operation. Therefore, it is possible to shorten the time required for writing the image signals onto the pixel electrodes or the time required for the inversion of the common electrodes.

Furthermore, the potential of the data lines turns to a potential substantially equal to the potential of the common electrode, not the pixel electrodes. Therefore, when the positive writing is performed, the potential of the data lines does not rise up to the potential of the pixel electrodes. On the other hand, when the negative writing is performed, the potential of the data lines is not lowered to the potential of the pixel electrodes. Therefore, it is possible to prevent a voltage higher than the voltage resistance of the data line driving circuit from being applied.

In the electro-optical device according to this aspect, it is preferable that the data line driving circuit include a shift register which, when a starting signal is input, transmits the starting signal in synchronization with a clock signal to sequentially output sampling signals.

According to this structure, when the starting signal is input, the shift register transmits the starting signal in synchronization with the clock signal to sequentially output the sampling signals. The image signals are sequentially supplied to the plurality of data lines one-by-one, in response to the sampling signals.

The dot sequential driving by the shift register enables the data line driving circuit to be formed in a simple structure, which makes it possible to easily manufacturing the data line driving circuit and thus to reduce the size thereof.

In the conventional electro-optical device performing the dot sequential driving, it is more difficult to ensure the time required for writing the image signals onto the pixel electrodes, as the density of pixels becomes higher. However, in the electro-optical device which includes the equalizer function circuit and performs the dot sequential driving, even when the density of pixels increases, it is possible to ensure the time required for writing the image signals onto the pixel electrodes since the potential of the data lines is changed in an optimal direction for the writing of the next image signal.

In the electro-optical device according to this aspect, preferably, the data line driving circuit includes a demultiplexer circuit having a plurality of transfer gates provided therein. Preferably, when the control signal and an inverted control signal obtained by inverting the control signal are input, the plurality of transfer gates are turned on or off in response to the control signal and the inverted control signal, and the plurality of transfer gates selectively distribute analog image signals.

According to this structure, one terminal of each of the transfer gates is connected to an input terminal of the demultiplexer circuit, and the other terminals of the transfer gates are connected to an output terminal of the demultiplexer circuit. An analog image signal composed of, for example, a plurality of R (red), G (green), and B (blue) image signals is supplied to the input terminal of the demultiplexer circuit, and various control signals are sequentially activated in synchronization with the supply of the analog image signal.

Then, the transfer gates sequentially turn from a high-impedance state to an on state, causing the data lines to be sequentially selected. In this way, only the R (red), G (green), and B (blue) image signals of the analog image signal are sequentially output from the output terminal and are then supplied to the corresponding data lines.

The demultiplexer circuit makes it possible to mix a plurality of image signals and to supply them. Therefore, it is possible to reduce the number of transmission paths, the size of a circuit, and power consumption.

In the electro-optical device according to this aspect, preferably, the data line driving circuit includes a D/A converting circuit which converts a digital video signal into an analog image signal, and performs digital line sequential driving for converting the digital video signal into the analog image signal and for supplying the converted analog image signal to the data lines.

According to this structure, the digital video signals are converted into the analog signals, in response to, for example, the sampling signals output from the shift register. Then, the analog signals are sequentially supplied to the data lines, thereby performing the digital line sequential driving.

In this way, in the digital line sequential driving, it is possible to supply the digital video signals to the data line driving circuit. Therefore, it is possible to further raise the noise resistance of a transmission path, as compared with a structure in which the analog image signals are supplied to the data line driving circuit.

BRIEF DESCRIPTION OF THE DRAWINGS

The invention will be described with reference to the accompanying drawings, wherein like numbers refer to like elements.

DESCRIPTION OF EXEMPLARY EMBODIMENTS

Figure 1:
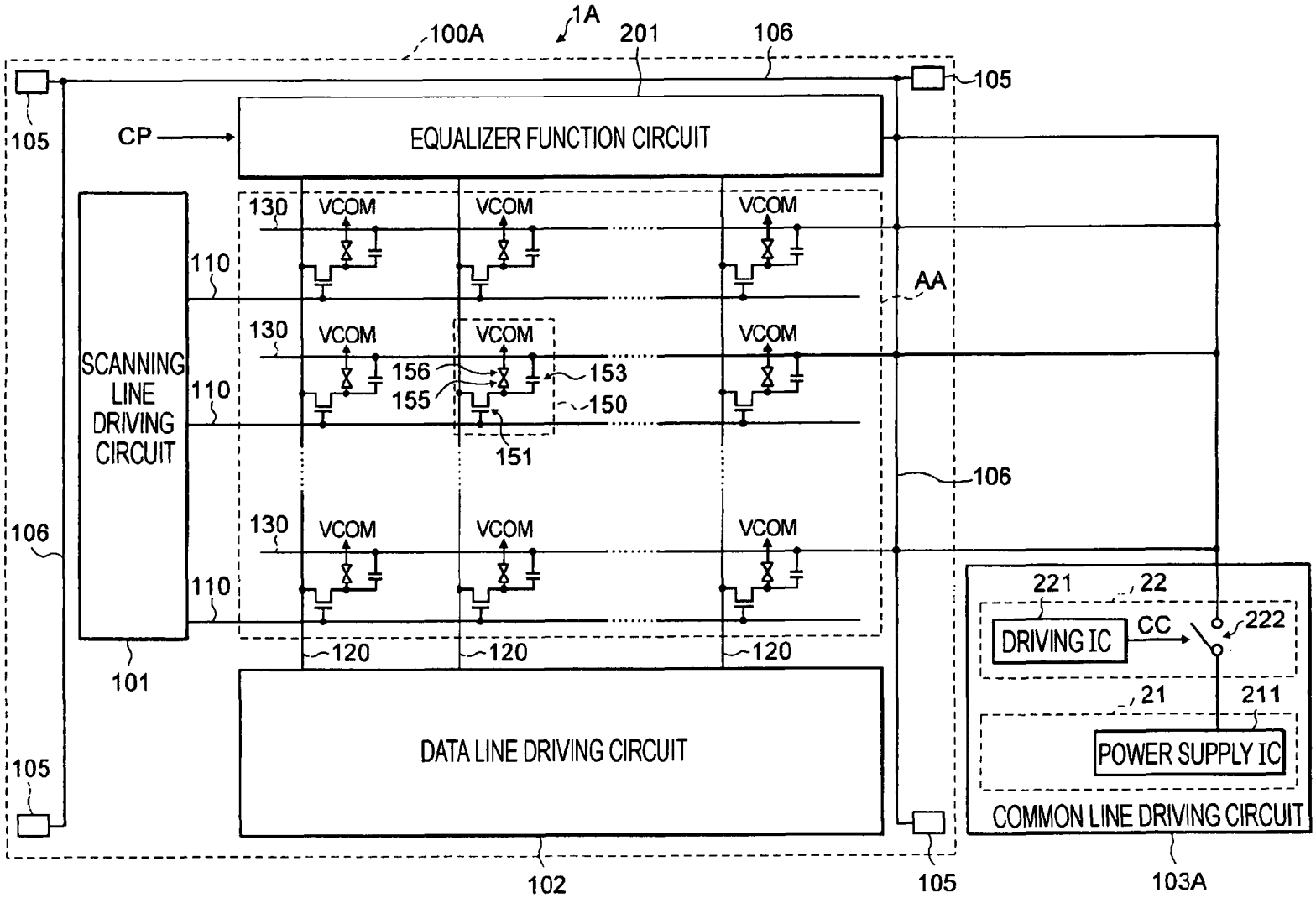
FIG. 1 is a plan view illustrating an electro-optical device according to a first embodiment of the invention.

Hereinafter, preferred embodiments of the invention will be described below with reference to the accompanying drawings. In the following embodiments, the same components have the same reference numerals, and thus a description thereof will be omitted or briefly made for the purpose of simplicity.

1. First Embodiment

Figure 11:
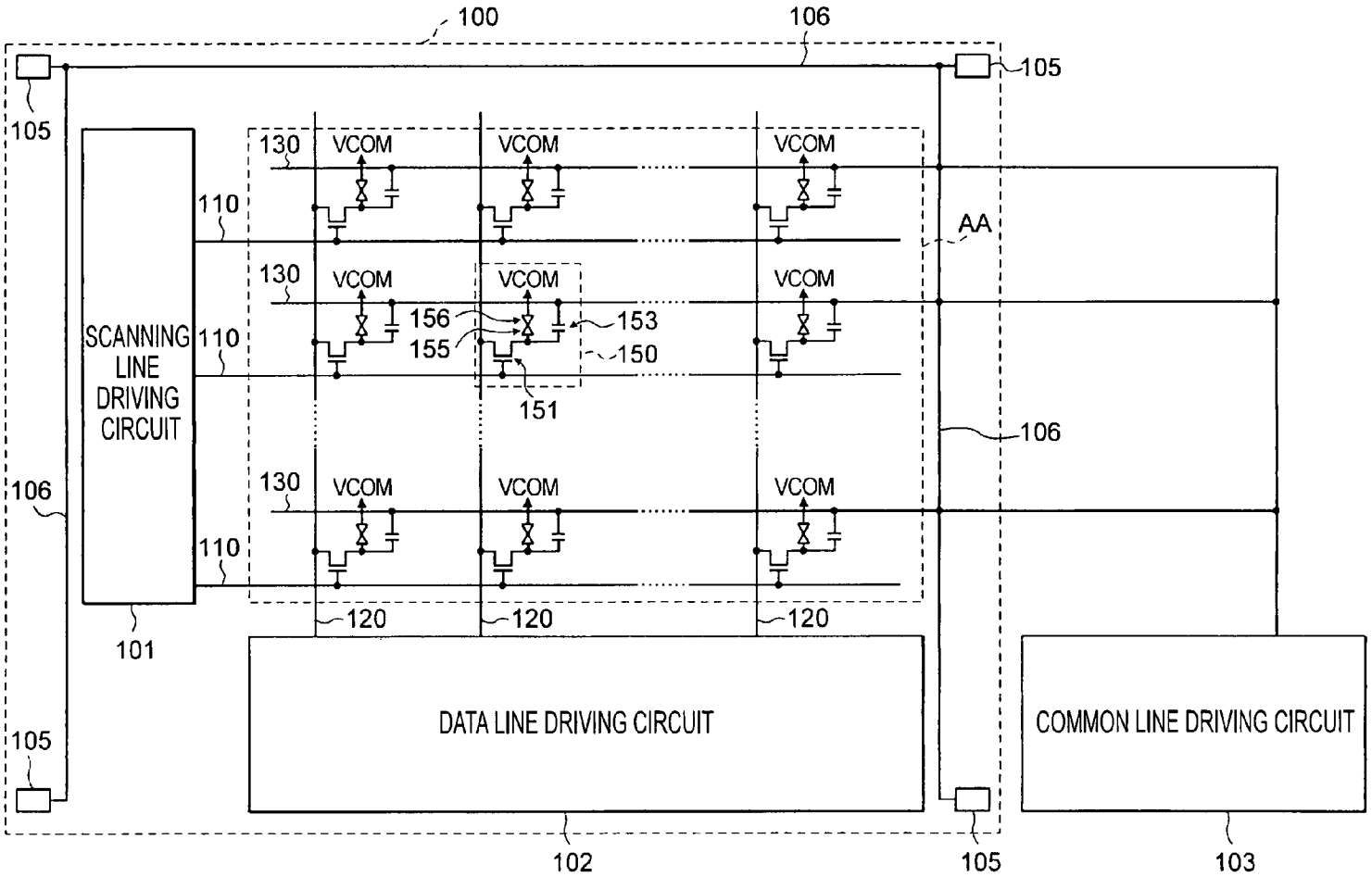
FIG. 11 Conventional Art
FIG. 11 is a plan view illustrating a conventional electro-optical device.
Figure 12:
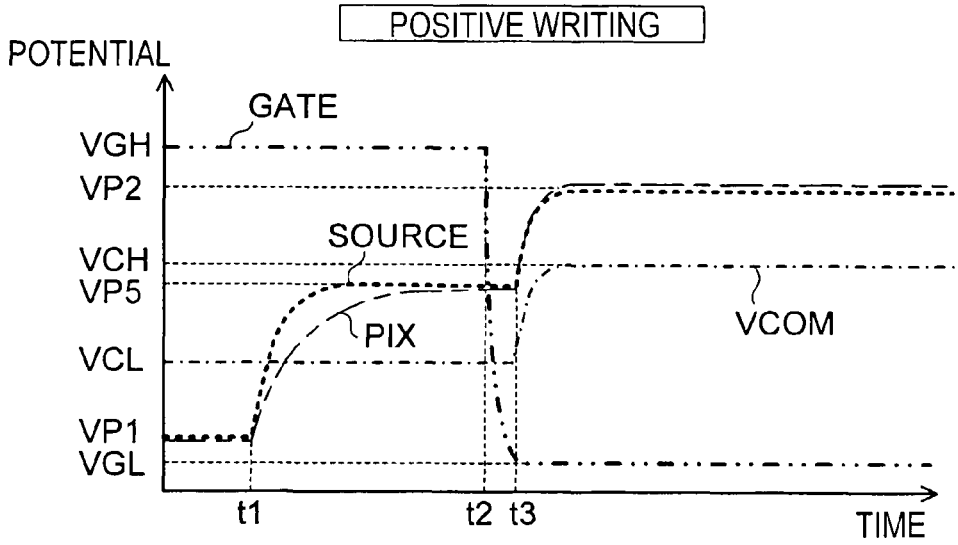
FIG. 12 is a timing chart of the conventional electro-optical device at the time of positive writing.
Figure 13:
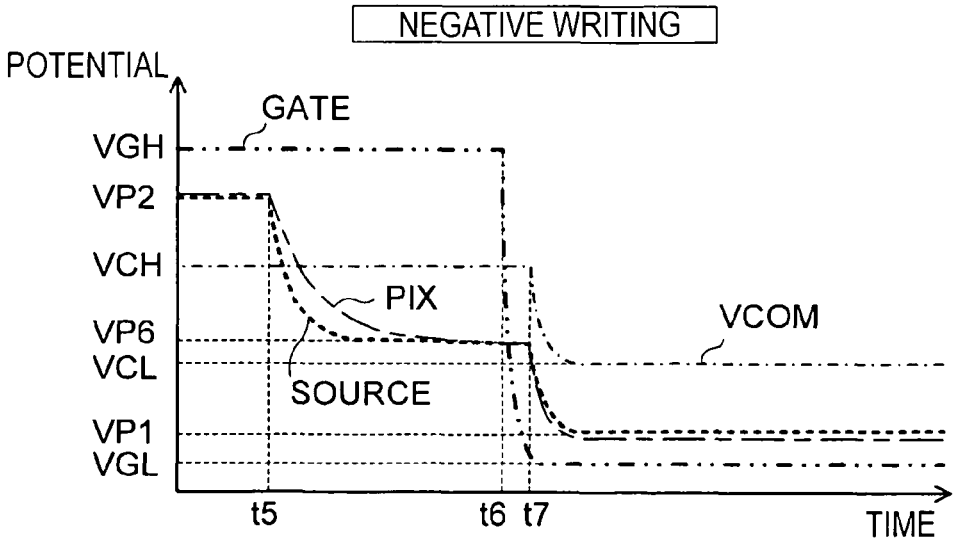
Conventional Art FIG. 13
FIG. 13 is a timing chart of the conventional electro-optical device at the time of negative writing.

FIG. 1 is a plan view illustrating an electro-optical device 1A according to a first embodiment of the invention. The electro-optical device 1A differs from an electro-optical device 1 shown in FIG. 11 in the structure of a common line driving circuit 103A and in that an equalizer function circuit 201 is provided.

The equalizer function circuit 201 intermittently connects/disconnects data lines 120 to/from common lines 130 in synchronization with a control signal CP. More specifically, in this embodiment, when the control signal CP is at an 'H' level, the equalizer function circuit 201 connects the data lines 120 and the common lines 130. On the other hand, when the control signal CP is at an 'L' level, the equalizer function circuit 201 disconnects the data lines 120 from the common lines 130.

The common line driving circuit 103A includes a driving signal supplying circuit 21 for supplying driving signals having a first potential and a second potential higher than the first potential and a driving signal supplying switch 22 for connecting/disconnecting the driving signal supplying circuit 21 to/from the common lines 130.

The driving signal supplying circuit 21 includes a power supply IC 211 for alternately outputting the first potential and the second potential within a predetermined period.

The driving signal supplying switch 22 includes a driving IC 221 for generating a control signal CC and a switching mechanism 222 which is turned on or off in response to the control signal CC output from the driving IC 221. More specifically, in this embodiment, when the control signal CC is at an 'H' level, the switching mechanism 222 disconnects the driving signal supplying circuit 21 from the common lines 130. On the other hand, when the control signal CC is at an 'L' level, the switching mechanism 222 connects the driving signal supplying circuit 21 and the common lines 130.

When the switching mechanism 222 is turned on by the control signal CC generated by the driving IC 221, the common line driving circuit 103A supplies, to the common lines 130, the first potential and the second potential alternately output from the power supply IC within a predetermined period.

Figure 2:
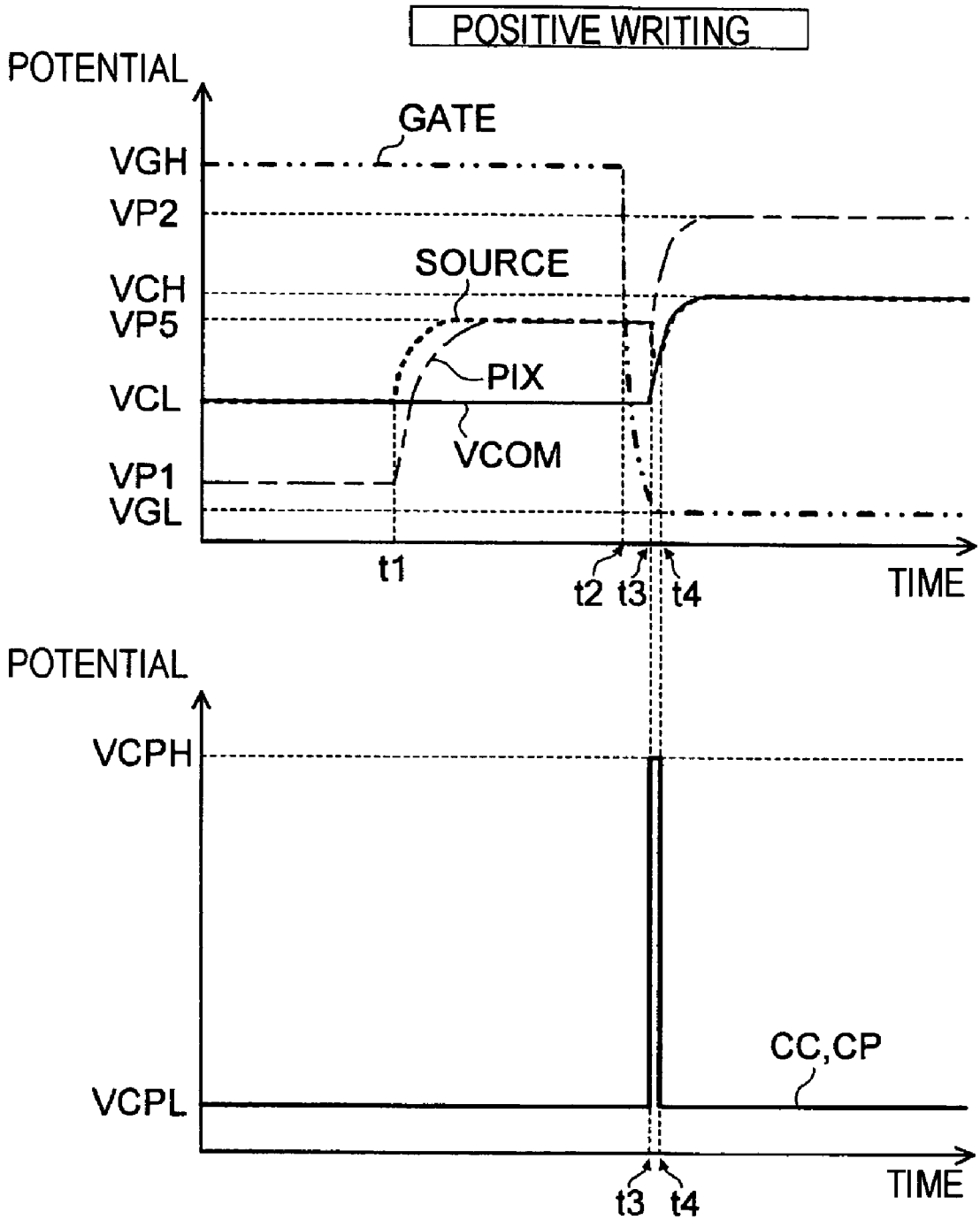
FIG. 2 is a timing chart of the electro-optical device using a common inversion driving method according to the embodiment at the time of positive writing.
Figure 3:
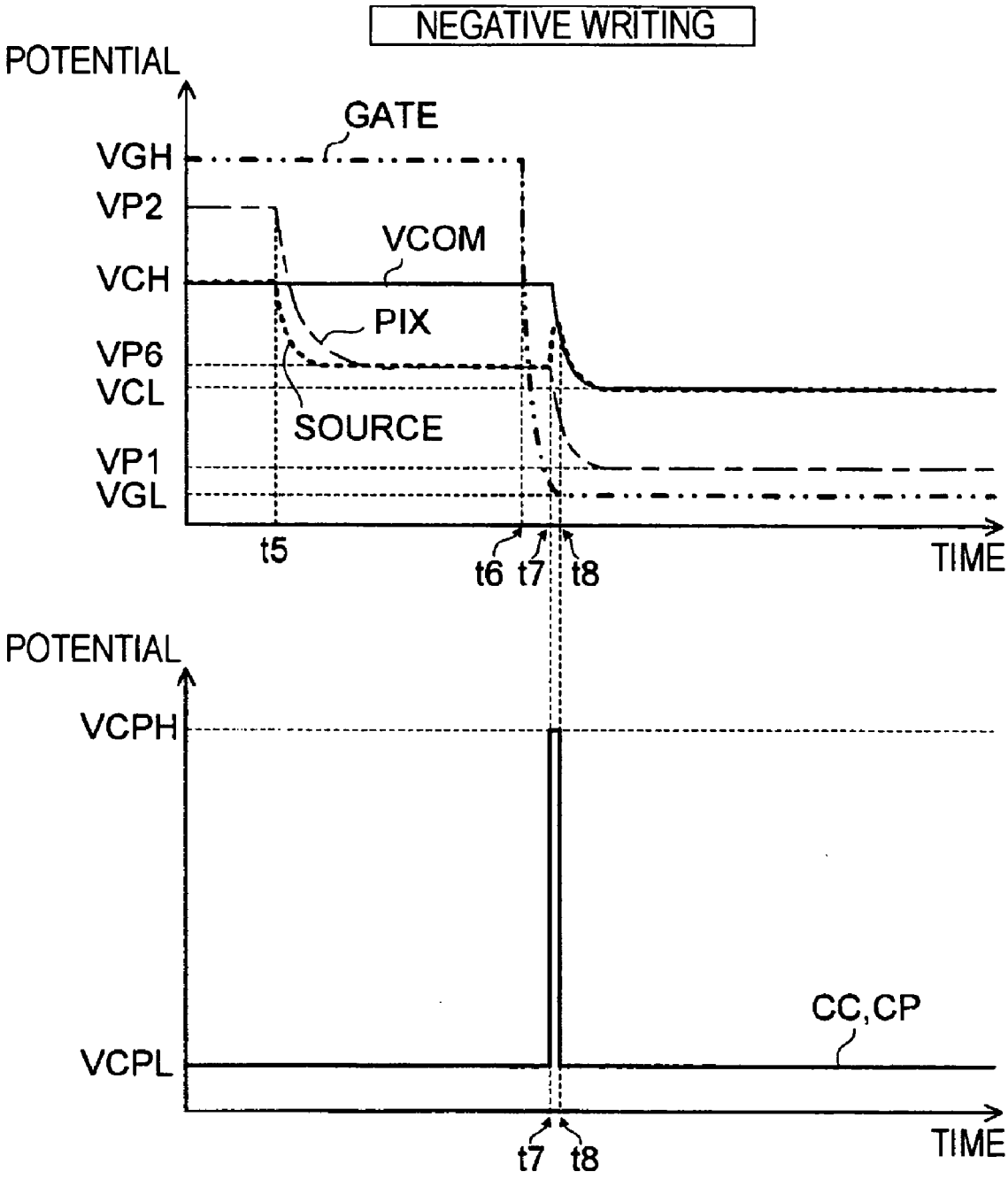
FIG. 3 is a timing chart of the electro-optical device using the common inversion driving method according to the embodiment at the time of negative writing.

FIG. 2 is a timing chart of the electro-optical device 1A using a common inversion driving method at the time of positive writing. FIG. 3 is a timing chart of the electro-optical device 1A using a common inversion driving method at the time of negative writing. FIGS. 2 and 3 show an example in which writing is performed at the same grayscale level. In FIGS. 2 and 3, characters VCOM indicate the potential of a common electrode 156, and characters SOURCE indicate the potential of the data line 120. In addition, characters GATE indicate the potential of the scanning line 110, and characters PIX indicate the potential of a pixel electrode 155.

As shown in FIG. 2, in the positive writing, first, the common line driving circuit 103A supplies a control signal for allowing the potential VCOM of the common electrode 156 to turn to a first potential VCL, and the scanning line driving circuit 101 supplies a control signal for allowing the potential GATE of the scanning lines 110 to turn to a potential VGH, thereby turning on TFTs 151. The connection between the data lines 120 and the common lines 130 by the equalizer function circuit 201, serving as an equalizing circuit, which will be described later, causes the potential SOURCE of the data lines 120 to be substantially equal to the potential VCOM of the common electrode 156.

Next, at a time t1, the data line driving circuit 102 supplies an image signal to raise the potential SOURCE of the data lines 120 from the potential VCL to a potential VP5, causing the image signal to be written onto the pixel electrodes 155 and storage capacitors 153 through the TFTs 151.

Next, at a time t2, the scanning line driving circuit 101 turns on the TFTs 151. Then, a difference between the first potential VCL of the common electrode 156 and the potential VP5 written onto the pixel electrodes 155 is applied to liquid crystal, and is then held by the storage capacitors 153.

Subsequently, at a time t3, the common line driving circuit 130A raises a potential VCOM of the common electrode 156 from the first potential VCL to a second potential VCH. Then, the potential PIX of the pixel electrodes 155 rises up to a potential VP2 together with the potential of the common electrode 156, with the difference between the potential PIX of the pixel electrodes 155 and the potential VCOM of the common electrode 156 kept constant. At that time, the data lines 120 are disconnected from the pixel electrodes 155 by the TFTs 151, but are capacitively connected to the common lines 130, which causes the potential SOURCE of the data lines 120 to rise up to the potential VP2 which is substantially equal to the potential PIX of the pixel electrodes 155.

At the time t3, the potential of the control signals CC and CP is changed from a potential VCPL to a potential VCPH. Then, the switching mechanism 222 is turned off, causing the equalizer function circuit 201 to connect the data lines 120 and the common lines 130. As a result, charges are moved between the data lines 120 and the common electrode 156 through the common lines 130, without the supply of a driving voltage from the driving signal supplying circuit 21, which causes the potential SOURCE of the data lines 120 to be substantially equal to the potential VCOM of the common electrode 156, not the potential PIX of the pixel electrodes 155.

Next, at a time t4, the potential of the control signals CC and CP is changed from the potential VCPH to the potential VCPL. Then, the switching mechanism 222 is turned on, causing the equalizer function circuit 201 to disconnect the data lines 120 from the common lines 130. As a result, the data lines 120 are disconnected from the pixel electrodes 155 by the TFTs 151, but are capacitively connected to the common lines 130, causing the potential SOURCE of the data lines 120 to rise to the second potential VCH together with the potential VCOM of the common electrode 156.

In this way, the potential SOURCE of the data lines 120 is substantially equal to the potential VCOM of the common electrode 156 by temporarily changing the potential of the control signals CC and CP to the potential VCPH. Then, since the data lines 120 are capacitively connected to the common lines 130, the potential of the control signals CC and CP turns to the potential VCPL, causing the potential SOURCE of the data lines 120 to rise up to a potential substantially equal to the second potential VCH together with the potential VCOM of the common electrode 156.

Next, in the negative writing, as shown in FIG. 3, first, the common line driving circuit 103A supplies a control signal for allowing the potential VCOM of the common electrode 156 to turn to the second potential VCH, and the scanning line driving circuit 101 supplies a control signal for allowing the potential GATE of the scanning lines 110 to turn to the potential VGH, thereby turning on TFTs 151. The connection between the data lines 120 and the common lines 130 by the equalizer function circuit 201 causes the potential SOURCE of the data lines 120 to be substantially equal to the potential VCOM of the common electrode 156.

Next, at a time t5, the data line driving circuit 102 supplies the image signal to lower the potential SOURCE of the data lines 120 from the potential VCH to a potential VP6, causing the image signal to be written onto the pixel electrodes 155 and the storage capacitors 153 through the TFTs 151.

Next, at a time t6, the scanning line driving circuit 101 turns on the TFTs 151. Then, the difference between the second potential VCH of the common electrode 156 and the potential VP6 written onto the pixel electrodes 155 is applied to liquid crystal, and is then held by the storage capacitors 153.

Subsequently, at a time t7, the common line driving circuit 130A lowers the potential VCOM of the common electrode 156 from the second potential VCH to the first potential VCL. Then, the potential PIX of the pixel electrodes 155 is lowered to a potential VP1 together with the potential of the common electrode 156, with the difference between the potential PIX of the pixel electrodes 155 and the potential VCOM of the common electrode 156 kept constant. At that time, the data lines 120 are disconnected from the pixel electrodes 155 by the TFTs 151, but are capacitively connected to the common lines 130, which causes the potential SOURCE of the data lines 120 to be lowered to the potential VP1 which is substantially equal to the potential PIX of the pixel electrodes 155.

At the time t7, the potential of the control signals CC and CP is changed from the potential VCPL to the potential VCPH. Then, the switching mechanism 222 is turned off, causing the equalizer function circuit 201 to connect the data lines 120 and the common lines 130. As a result, charges are moved between the data lines 120 and the common electrode 156 through the common lines 130, without the supply of the driving voltage from the driving signal supplying circuit 21, which causes the potential SOURCE of the data lines 120 to be substantially equal to the potential VCOM of the common electrode 156, not the potential PIX of the pixel electrodes 155.

Next, at a time t8, the potential of the control signals CC and CP is changed from the potential VCPH to the potential VCPL. Then, the switching mechanism 222 is turned on, causing the equalizer function circuit 201 to disconnect the data lines 120 from the common lines 130. As a result, the data lines 120 are disconnected from the pixel electrodes 155 by the TFTs 151, but are capacitively connected to the common lines 130, causing the potential SOURCE of the data lines 120 to be lowered to the first potential VCL together with the potential VCOM of the common electrode 156.

In this way, the potential SOURCE of the data lines 120 is substantially equal to the potential VCOM of the common electrode 156 by temporarily changing the potential of the control signals CC and CP to the potential VCPH. Then, since the data lines 120 are capacitively connected to the common lines 130, the potential of the control signals CC and CP turns to the potential VCPL, causing the potential SOURCE of the data lines 120 to be lowered to a potential substantially equal to the first potential VCL together with the potential VCOM of the common electrode 156.

According to this embodiment, the following effects can be obtained.

(1) When the switching mechanism 222 is temporarily turned off, the movement of charges occurs between the data lines 120 and the common electrodes 156, without the supply of the driving voltage from the driving signal supplying circuit 21, which makes it possible to change the potential of the data lines 120 or the common electrode 156 by using the charges, and thus to reduce power consumption.

(2) The potential of the data lines 120 is changed in an optimal direction for the writing of the next image signal, and the potential of the common electrode 156 is also changed in an optimal direction for the next inverting operation. Therefore, it is possible to shorten the time required for writing the image signals onto the pixel electrodes 155 or the time required for the inversion of the common electrodes 156.

(3) In the positive writing, since the data lines 120 has a potential substantially equal to the potential of the common electrode 156, not the pixel electrodes 155, the potential of the data lines 120 does not rise up to the potential of the pixel electrodes 155. On the other hand, in the negative writing, the potential of the data lines 120 is not lowered to the potential of the pixel electrodes 155. Therefore, it is possible to prevent a voltage higher than the voltage resistance of the data line driving circuit 102 from being applied.

2. Second Embodiment

Figure 4:
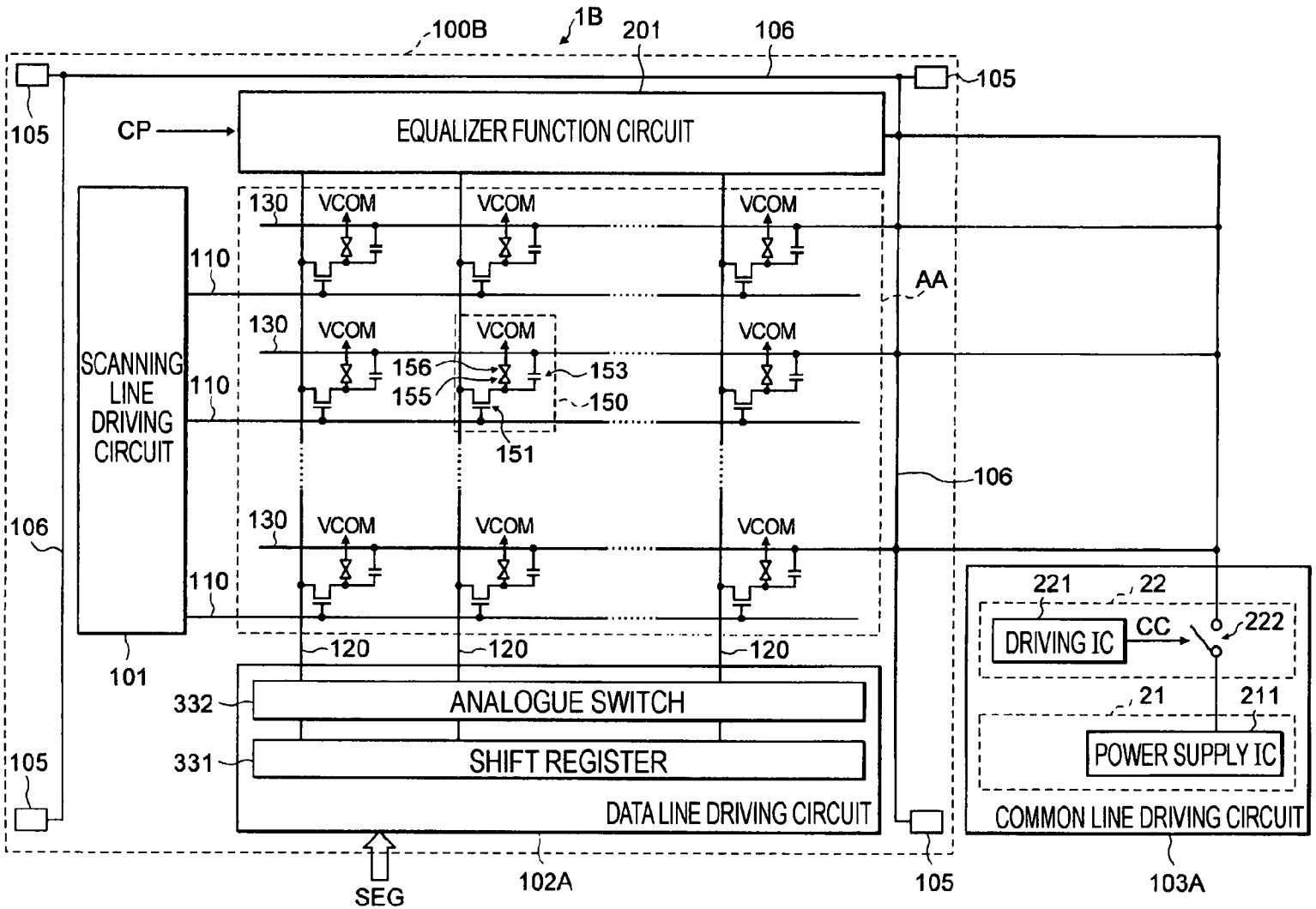
FIG. 4 is a plan view illustrating an electro-optical device according to a second embodiment of the invention.

FIG. 4 is a plan view illustrating an electro-optical device 1B according to a second embodiment of the invention. The electro-optical device 1B differs from the electro-optical device 1A shown in FIG. 1 in that the structure of a data line driving circuit 102A.

The data line driving circuit 102A includes a shift register 331 for, when a starting signal is input, transmitting the starting signal in synchronization with a clock signal to sequentially output sampling signals and an analog switch 332 for sequentially selecting the data lines 120 in response to the sampling signals from the shift register 331.

According to the data line driving circuit 102A, when the starting signal is input to the shift register 331, the shift register 331 outputs the sampling signal, and the analog switch 332 sequentially selects the data lines 120 in response to the sampling signal output from the shift register 331. Then, the image signal is supplied to the data line 120 selected by the analog switch 322, thereby performing dot sequential driving.

A timing chart for the electro-optical device 1B according to this embodiment is the same as that for the electro-optical device 1A. The operation between the time t3 and the time t4 in FIG. 2 and the operation between the time t7 and the time t8 in FIG. 3 are performed in a blocking period of the electro-optical device 1B.

According to this embodiment, the following effects are obtained in addition to the effects (1) to (3).

(4) In the dot sequential driving by the shift register, since the data line driving circuit 102A is formed in a simple structure, which makes it possible to easily manufacture the data line driving circuit and to reduce the size thereof.

(5) In the conventional electro-optical device using the dot sequential driving method, as the density of pixels becomes higher, it is more difficult to ensure the time required for writing image signals onto the pixel electrodes. However, in the electro-optical device 1B including the equalizer function circuit 201, which is the equalizing circuit, and performing the dot sequential driving, even when the density of pixels increases, it is possible to ensure the time required for writing the image signals onto the pixel electrodes 155 since the potential of the data lines 120 is changed in an optimal direction for the writing of the next image signal.

3. Third Embodiment

Figure 5:
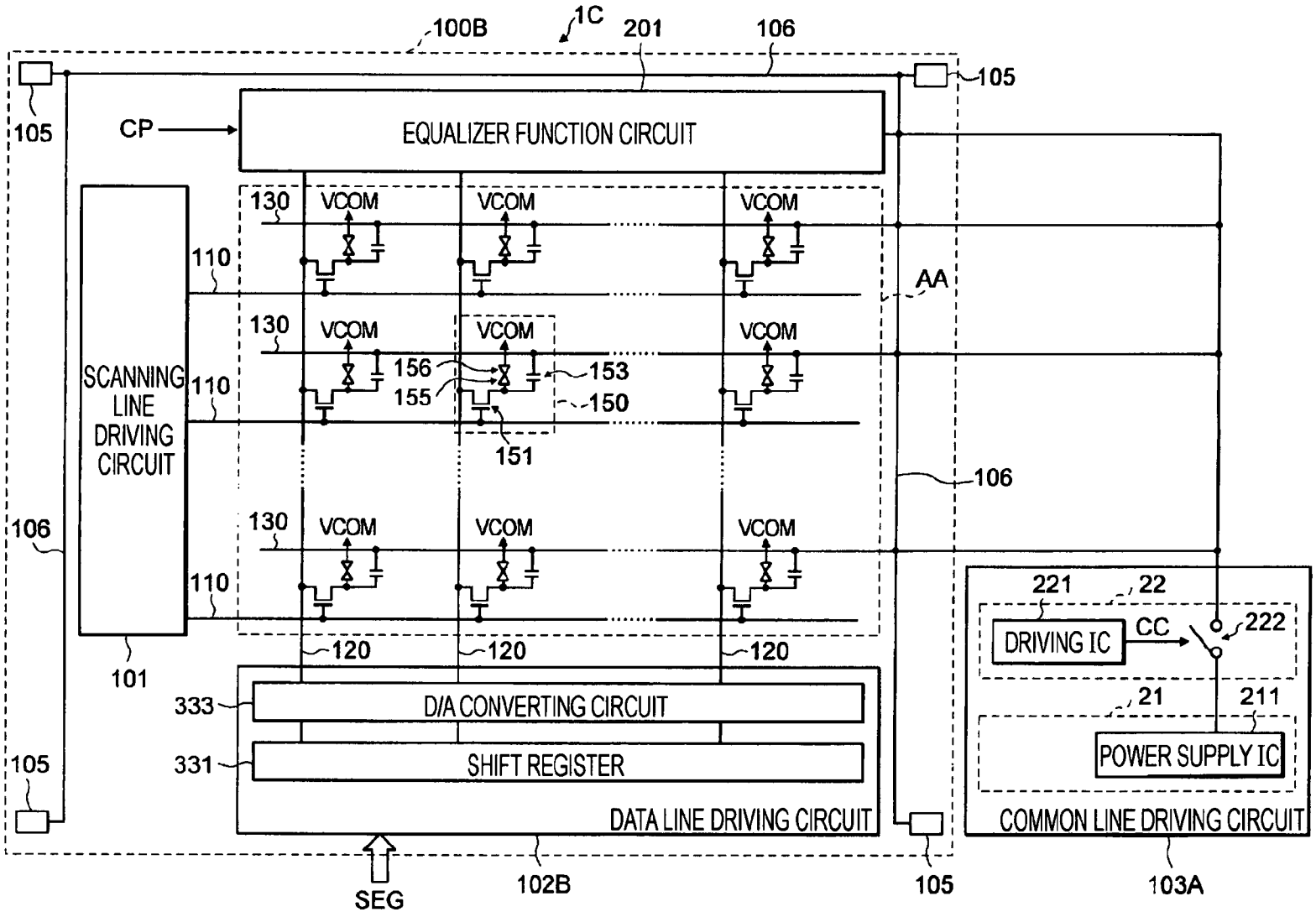
FIG. 5 is a plan view illustrating an electro-optical device according to a third embodiment of the invention.

FIG. 5 is a plan view illustrating an electro-optical device 1C according to a third embodiment of the invention. The electro-optical device 1C differs from the electro-optical panel 1B shown in FIG. 4 in the structure of a data line driving circuit 102B.

The data line driving circuit 102B includes a digital line sequential circuit. The digital line sequential circuit has a shift register 331 for, when a starting signal is input, transmitting the starting signal in synchronization with a clock signal to sequentially output sampling signals and a D/A converting circuit 333 for converting supplied digital video signals into analog image signals.

According to the data line driving circuit 102B, when the starting signal is input to the shift register 331, the shift register 331 outputs the sampling signal, and the D/A converting circuit 333 converts the digital video signals into the analog image signals, in response to the sampling signals output from the shift register 331. Then, the data line driving circuit 120B supplies the image signals to the data lines 120, thereby performing digital line sequential driving.

A timing chart for the electro-optical device 1C according to this embodiment is the same as that for the electro-optical device 1A. The operation between the time t3 and the time t4 in FIG. 2 and the operation between the time t7 and the time t8 in FIG. 3 are performed in a blocking period of the electro-optical device 1C.

According to this embodiment, the following effect is obtained in addition to the effects (1) to (3).

(6) In the digital line sequential driving, it is possible to supply the digital video signals to the data line driving circuit 102B. Therefore, it is possible to further raise the noise resistance of a transmission path, as compared with a structure in which the analog image signals are supplied to the data line driving circuit 102B.

4. Fourth Embodiment

Figure 6:
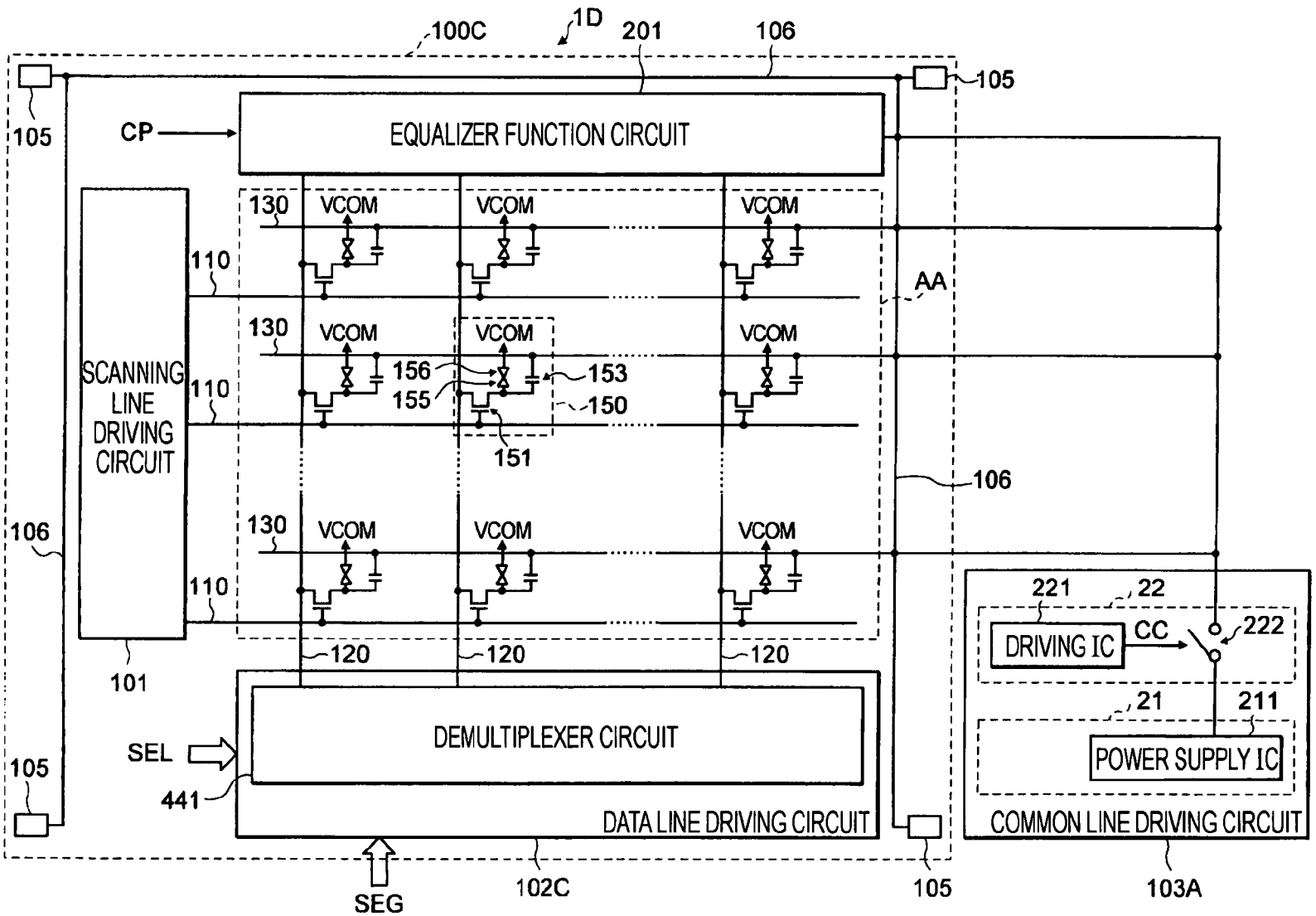
FIG. 6 is a plan view illustrating an electro-optical device according to a fourth embodiment of the invention.

FIG. 6 is a plan view illustrating an electro-optical device 1D according to a fourth embodiment of the invention. The electro-optical device 1D differs from the electro-optical device 1C shown in FIG. 5 in the structure of a data line driving circuit 1C.

The data line driving circuit 102C includes a demultiplexer circuit 441 for, when a control signal SEL is input, outputting a plurality of image signals on the basis of an analog image signal SEG composed of a plurality of supplied image signals, in response to the control signal SEL.

Figure 7:
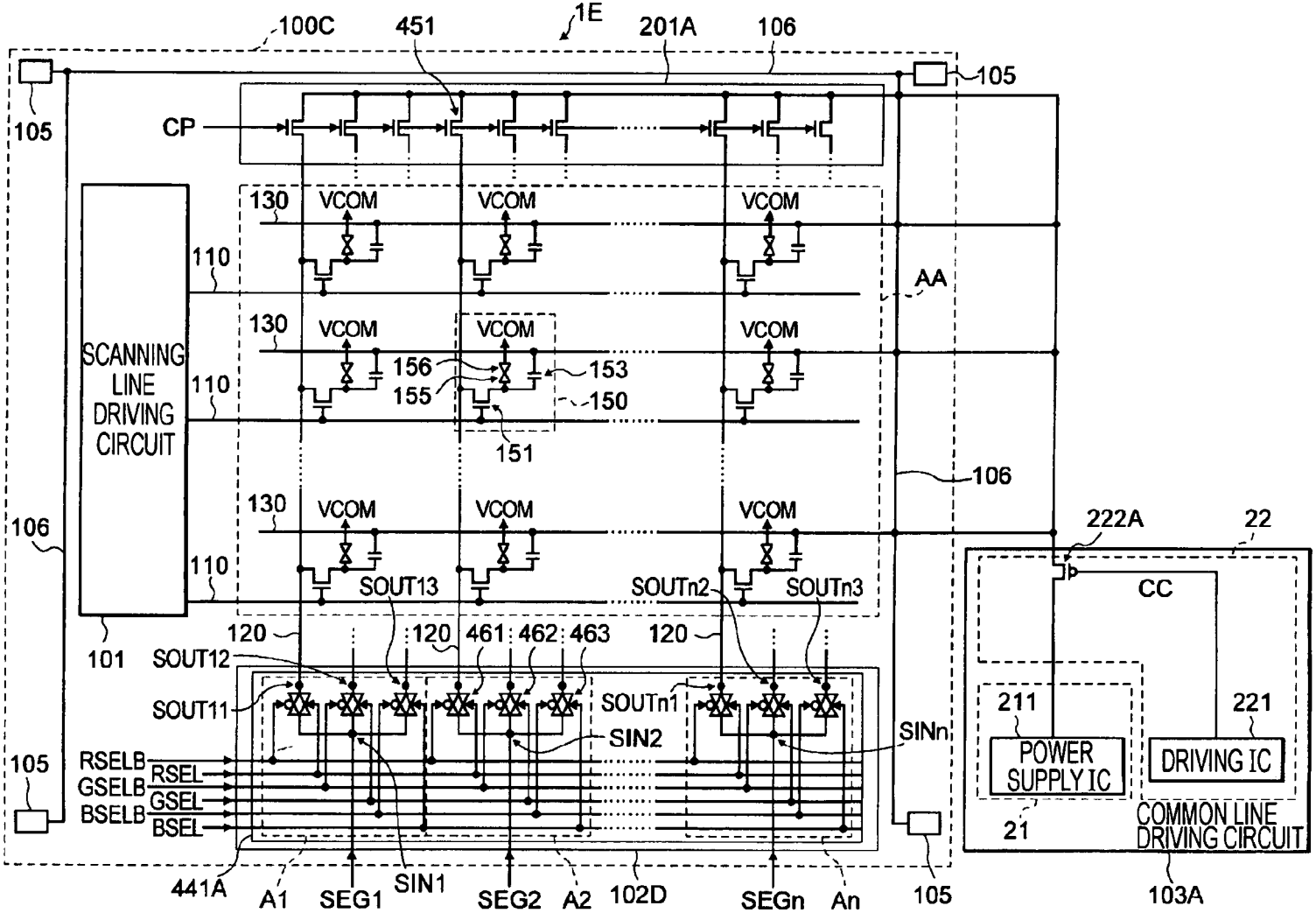
FIG. 7 is a circuit diagram of the electro-optical device according to the embodiment.

FIG. 7 is a circuit diagram illustrating an electro-optical device 1E. The electro-optical device 1E includes the equalizer function circuit 201, serving as an equalizing circuit, the multiplexer circuit 441, and the switching mechanism 222 included in the electro-optical device 1D shown in FIG. 6.

A data line driving circuit 102D is composed of n demultiplexer unit circuits A1 to An. Here, n is a natural number larger than 2.

The demultiplexer unit circuits A1 to An each have first, second, and third transfer gates 461, 462, and 463. More specifically, in the demultiplexer unit circuit Am (for example, m is a natural number equal to or smaller than n), one terminal of each of the first to third transfer gates 461 to 463 is connected to an input terminal SINm, and the other terminals of the first to third transfer gates 461 to 463 are connected to output terminals SOUTm1 to SOUTm3, respectively.

The output terminals SOUTm1 to SOUTm3 are connected to R (red), G (green), and B (blue) data lines 120, respectively. That is, the multiplexer unit circuit Am supplies the image signals to R (red), G (green), and B (blue) sub-pixels.

An analog image signal SEGm composed of R (red), G (green), and B (blue) image signals is input to the input terminal SINm.

An R control signal RSEL and an inverted R control signal RSELB obtained by inverting the R control signal RSEL are supplied to control terminals of the first transfer gates 461 of the demultiplexer unit circuits A1 to An.

When the R control signal RSEL and the inverted R control signal RSELB are activated, the transfer gate 461 is turned on, causing the R (red) image signal of the analog image signal input to the input terminal SINm to be supplied to the R (red) data line 120.

A G control signal GSEL and an inverted G control signal GSELB obtained by inverting the G control signal are supplied to control terminals of the second transfer gates 462 of the demultiplexer unit circuits A1 to An.

When the G control signal GSEL and the inverted G control signal GSELB are activated, the transfer gate 462 is turned on, causing the G (green) image signal of the analog image signal input to the input terminal SINm to be supplied to the G (green) data line 120.

A B control signal BSEL and an inverted B control signal BSELB obtained by inverting the B control signal are supplied to control terminals of the third transfer gates 463 of the demultiplexer unit circuits A1 to An.

When the B control signal BSEL and the inverted B control signal BSELB are activated, the transfer gate 463 is turned on, causing the B (blue) image signal of the analog image signal input to the input terminal SINm to be supplied to the B (blue) data line 120.

The demultiplexer circuit 441A is operated as follows.

The demultiplexer circuit 441A supplies the analog image signals SEG1 to SEGn to the input terminals SIN1 to SINn of the demultiplexer unit circuits A1 to An, respectively, and activates any one of the R control signal RSEL and the inverted R control signal RSELB, the G control signal GSEL and the inverted G control signal GSELB, and the B control signal BSEL and the inverted B control signal BSELB. In this way, a specific data line 120 is selected from the R (red), G (green), and B (blue) data lines 120, and the image signal is supplied to the selected data line 120.

Therefore, it is possible to extract the R (red), G (green), and B (blue) image signals from the analog image signal composed of the R (red), G (green), and B (blue) image signals.

A timing chart for the electro-optical device 1E according to this embodiment is the same as that for the electro-optical device 1A. The operation between the time t3 and the time t4 in FIG. 2 and the operation between the time t7 and the time t8 in FIG. 3 are performed whenever the image signals are supplied from the demultiplexer circuit 441A of the electro-optical device 1E to the data lines 120.

According to this embodiment, the following effect is obtained in addition to the effects (1) to (3).

(7) In the demultiplexer circuit 441A, it is possible to mix a plurality of image signals to supply them and thus to reduce the number of transmission paths. Thus, it is possible to reduce the size of a circuit and power consumption.

5. Modifications

The invention is not limited to the above-described embodiments, but various modifications and changes of the invention can be made within the scope capable of achieving the object of the invention.

For example, the driving signal supplying switch for connecting or disconnecting the common lines to or from the common line driving circuit may be provided outside a common line driving circuit for supplying driving signals to the common lines.

Further, the common line driving circuit may be provided on an element substrate.

Furthermore, the same driving signal is supplied to a counter electrode and the storage capacitors. However, different driving signals may be supplied to the counter electrode and the storage capacitors.

Moreover, the control signal CP supplied to the equalizer function circuit and the control signal CC supplied to the driving signal supplying switch may be different from each other during operational timing.

6. Electro-Optical Device

Figure 8:
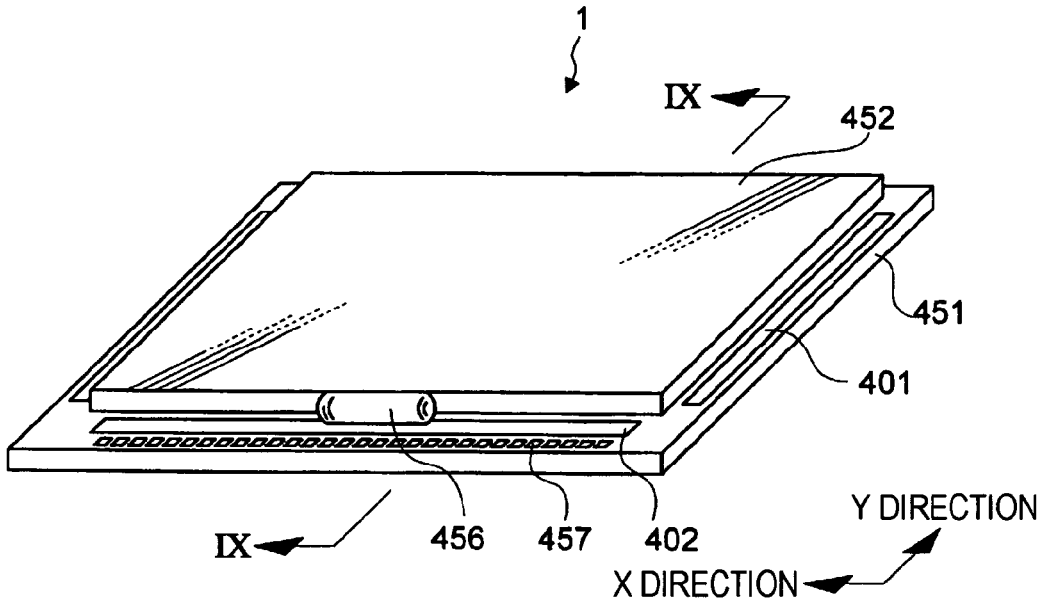
FIG. 8 is a perspective view illustrating the structure of an electro-optical device 1 according to the above-described embodiments and a modification.
Figure 9:
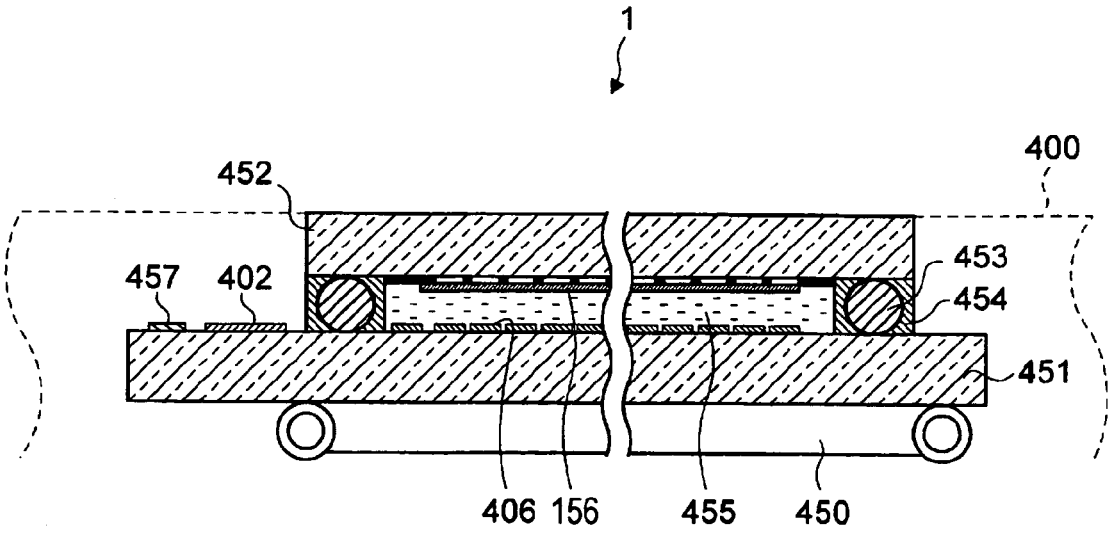
FIG. 9 is a cross-sectional view taken along the line IX-IX' of FIG. 8.

FIG. 8 is a perspective view illustrating the structure of an electro-optical device according to the above-described embodiments and the modifications. FIG. 9 is a cross-sectional view taken along the line IX-IX' of FIG. 8.

The electro-optical device 1 is encased in a housing 400 (represented by a dashed line in FIG. 9). The electro-optical device 1 includes an element substrate 451 having, for example, pixel electrodes 406 formed thereon, a counter substrate 452 which is arranged opposite to the element substrate 451 and has, for example, a common electrode 156 formed thereon, liquid crystal 455, serving as an electro-optical material, which is provided between the element substrate 451 and the counter substrate 452, and a backlight 450 which is provided on the lower side (a side opposite to the counter substrate 452) of the element substrate 451 to emit light to the liquid crystal 455. The element substrate 451 is formed of, for example, a semiconductor or glass, and various types of circuits using TFTs (thin film transistors) are formed on the element substrate 451. The counter substrate 452 is formed of a transparent material, such as glass.

Further, a sealing member 454 for sealing a gap between the element substrate 451 and the counter substrate 452 is provided in the outer periphery of the counter substrate 452. The sealing member 454 forms a space for injecting the liquid crystal 455 together with the element substrate 451 and the counter substrate 452. Spacers 453 for keeping the gap between the element substrate 451 and the counter substrate 452 are dispersed into the sealing member 454. In addition, an opening for injecting the liquid crystal 455 is formed in the sealing member 454, and is sealed by a sealing material 456 after the liquid crystal 455 is injected.

On a surface of the element substrate 451 facing the counter substrate 452, a data line driving circuit 401 for driving data lines extending in the Y direction is formed outside one side of the sealing member 454. In addition, a plurality of connecting electrodes 457 are formed along the one side, and various signals are input through the connecting electrodes 457. Scanning line driving circuits 402 for driving scanning lines (which will be described later) extending in the X direction are formed along two sides of the sealing member 454 adjacent to the one side thereof.

7. Electronic Apparatus

Figure 10:
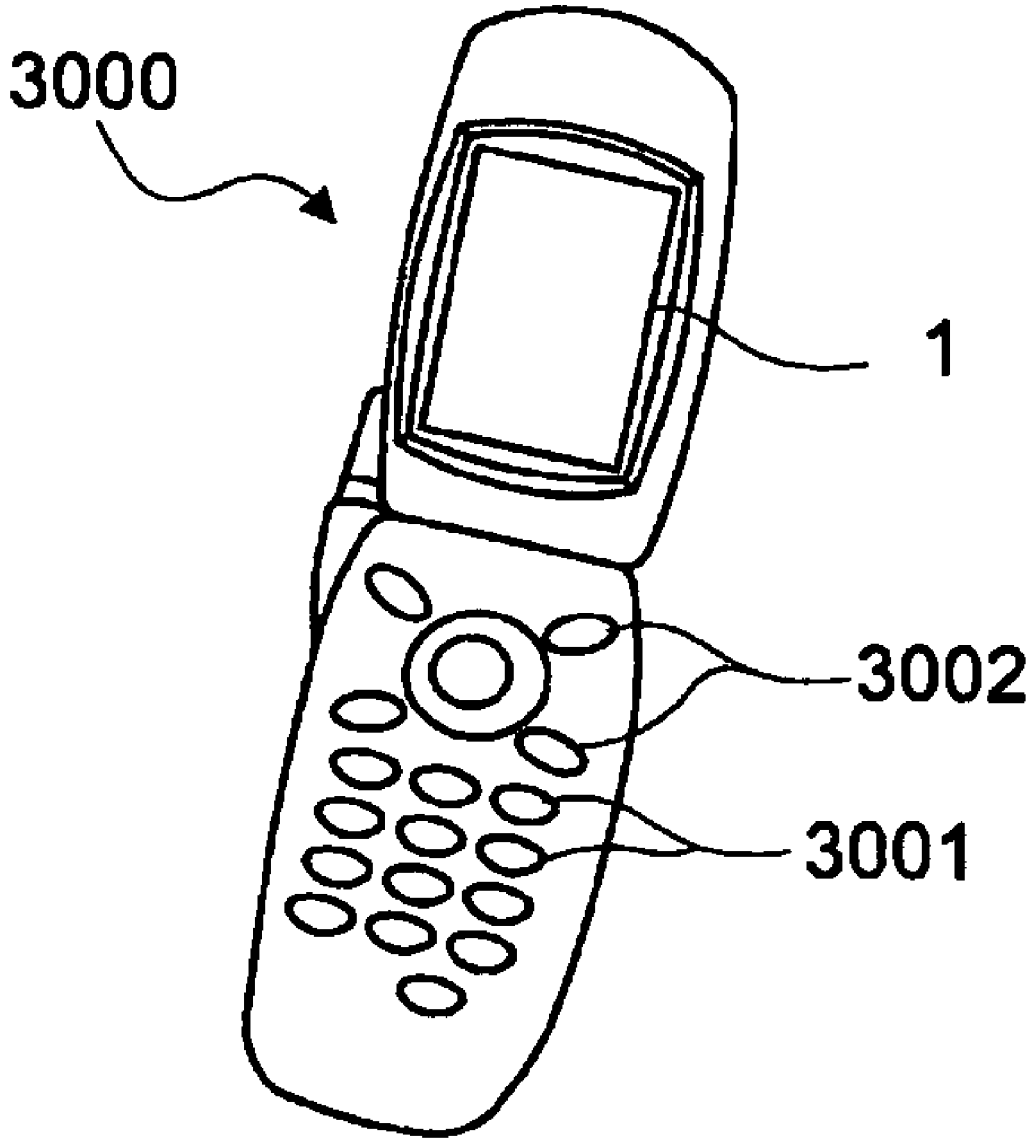
FIG. 10 is a perspective view illustrating the structure of a cellular phone to which the above-mentioned electro-optical device.

Next, an electronic apparatus to which the electro-optical device 1 according to the above-described embodiment is applied will be described below. FIG. 10 shows the structure of a cellular phone to which the electro-optical device 1 is applied. A cellular phone 3000 includes a plurality of operating buttons 3001, a plurality of scroll buttons 3002, and the electro-optical device 1 serving as a display unit. The scroll button 3002 is operated to scroll an image displayed on the electro-optical device 1.

The entire disclosure of Japanese Patent Application Nos: 2005-162214, filed Jun. 2, 2005, and 2006-76307, filed Mar. 20, 2006, are expressly incorporated by reference herein.

What is claimed is:

1. An electro-optical device comprising:

a first substrate which includes a plurality of scanning lines;

a plurality of data lines that are provided so as to be substantially orthogonal to the plurality of scanning lines;

a plurality of common lines that are provided so as to be substantially parallel to the scanning lines; and a plurality of pixel circuits that are provided at each of intersections of the plurality of scanning lines and the plurality of data lines, each of the plurality of pixel circuits having:

a pixel electrode;

a storage capacitor which has one end connected to the pixel electrode and the other end connected to one of the plurality of common lines; and a switching element which connects and disconnects one of the plurality of data lines to or from the pixel electrode and the storage capacitor, in response to a control signal transmitted through the one of the plurality of scanning lines;

a second substrate which is provided opposite to the first substrate and has a plurality of common electrodes each connected to the plurality of common lines thereon;

an electro-optical material which is provided between the first substrate and the second substrate;

a common line driving circuit which includes a power supply that supplies, to the plurality of common lines, a driving signal having a first potential or a second potential higher than the first potential;

a data line driving circuit which supplies each of image signals to each of the plurality of data lines at a potential higher than the first potential when the potential of each common electrode is the first potential, and supplies each of the image signals to the plurality of data lines at a potential lower than the second potential when the potential of each common electrode is the second potential;

a scanning line driving circuit which supplies, to each of the plurality of scanning lines, each of the control signals for turning on and off each switching element; and an equalizing circuit which connects or disconnects the plurality of data lines to and from the plurality of common lines and equalizes each of the plurality of data lines with each of the plurality common lines, the common line driving circuit including a driving signal supplying circuit for supplying the driving signal having the first potential or the second potential and a driving signal supplying switch for connecting and disconnecting the driving signal supplying circuit to and from all the plurality of common lines at a same time.

2. The electro-optical device according to claim 1, the data line driving circuit including a shift register which, when a starting signal is input, transmits the starting signal in synchronization with a clock signal to sequentially output sampling signals.

3. The electro-optical device according to claim 1, the data line driving circuit including a demultiplexer circuit having a plurality of transfer gates provided therein, when the control signal and an inverted control signal obtained by inverting the control signal are inputted, the plurality of transfer gates being turned on and off in response to the control signal and the inverted control signal, and the plurality of transfer gates selectively distributing analog image signals.

4. The electro-optical device according to claim 1, the data line driving circuit including a D/A converting circuit which converts a digital video signal into an analog image signal, and performing digital line sequential driving for converting the digital video signal into the analog image signal and for supplying the converted analog image signal to the plurality of data lines.

5. An electronic apparatus comprising the electro-optical device according to claim 1.

6. A method of driving an electro-optical device, the electro-optical device including:

a first substrate which includes a plurality of scanning lines;

a plurality of data lines that are provided so as to be substantially orthogonal to the plurality of scanning lines;

a plurality of common lines that are alternately provided so as to be substantially parallel to the scanning lines; and a plurality of pixel circuits that are provided so as to correspond to each of intersections of the plurality of scanning lines and the plurality of data lines, each of the plurality of pixel circuits having:

a pixel electrode;

a storage capacitor which has one end connected to the pixel electrode and the other end connected to one of the common lines; and a switching element which connects and disconnects one of the plurality of data lines to or from the pixel electrode and the storage capacitor, in response to a control signal transmitted through one of the plurality of scanning lines;

a second substrate which is provided opposite to the first substrate and has a plurality of common electrodes each connected to the plurality of common lines;

an electro-optical material which is provided between the first substrate and the second substrate;

a common line driving circuit which supplies, to the plurality of common lines, a driving signal having a first potential or a second potential higher than the first potential;

a data line driving circuit which supplies each of image signals to each of the plurality of data lines at a potential higher than the first potential when the potential of each common electrode is the first potential, and supplies each of the image signals to the plurality of data lines at a potential lower than the second potential when the potential of each common electrode is the second potential; and a scanning line driving circuit which supplies, to each of the plurality of scanning lines, each of control signals for turning on and off each switching element;

the common line driving circuit including a driving signal supplying circuit for supplying the driving signal having the first potential or the second potential and a driving signal supplying switch for connecting and disconnecting the driving signal supplying circuit to and from the plurality of common lines, the method comprising:

turning on the driving signal supplying switch to apply the first potential to each common electrode, supplying each of the control signals from the scanning line driving circuit to each of the plurality of scanning lines to turn on each switching element, and supplying each of the image signals from the data line driving circuit to each of the plurality of data lines to write each of the plurality of image signals onto each pixel electrode and each storage capacitor through each switching element;

allowing the scanning line driving circuit to turn on each switching element to apply a difference between the first potential of each common electrode and the potential written onto each pixel electrode to liquid crystal, and to hold the applied potential by each storage capacitor;

allowing the driving signal supplying circuit to raise the potential of each common electrode from the first potential to the second potential;

allowing the scanning line driving circuit to turn on each switching element to apply a difference between the second potential of each common electrode and the potential written onto each pixel electrode to the liquid crystal, and to hold the applied potential by each storage capacitor; and allowing the driving signal supplying circuit to lower the potential of each common electrode from the second potential to the first potential, the steps being repeatedly performed, in the allowing of the driving signal supplying circuit to raise the potential, the driving signal supplying switch being temporarily turned off, the plurality of data lines and the plurality of common lines being connected to each other, and the driving signal supplying circuit raising the potential of each common electrode from the first potential to the second potential, and in the allowing of the driving signal supplying circuit to lower the potential, the driving signal supplying switch being temporarily turned off, the plurality of data lines and the plurality of common lines being connected to each other, and the driving signal supplying circuit lowering the potential of each common electrode from the second potential to the first potential.

7. An electro-optical device comprising:

a pair of substrates is disposed so as to face each other and sandwich an electro-optical material;

a plurality of scanning lines;

a plurality of data lines that are provided so as to be substantially orthogonal to the plurality of scanning lines;

a plurality of common lines that are provided so as to be substantially parallel to the plurality of scanning lines;

a plurality of pixel electrodes that is each disposed at each of intersections of the plurality of scanning lines and the plurality of data lines;

a plurality of switching elements which each connects and disconnects one of the plurality of data lines to and from one of the plurality of pixel electrodes;

a plurality of storage capacitors which each has one end connected to respective one of the plurality of pixel electrodes and the other end connected to respective one of the plurality of common lines;

a common line driving circuit which includes a power supply that supplies, to the plurality of common lines, a driving signal having a first potential or a second potential higher than the first potential;

a data line driving circuit which supplies each of image signals to each of the plurality of data lines at a potential higher than the first potential when the potential of the plurality of common lines is the first potential, and supplies each of the image signals to each of the plurality of data lines at a potential lower than the second potential when the potential of the plurality of common lines is the second potential;

a scanning line driving circuit which supplies, to each of the plurality of scanning lines, each of control signals for turning on or off each of the plurality of switching elements; and an equalizing circuit which connects and disconnects the plurality of data lines to and from the plurality of common lines and equalizes each of the plurality of data lines with each of the plurality common lines, the common line driving circuit including a driving signal supplying circuit for supplying the driving signal having the first potential or the second potential and a driving signal supplying switch for connecting and disconnecting the driving signal supplying circuit to and from all the plurality of common lines at a same time.

8. A method of driving an electro-optical device, the electro-optical device including:

a pair of substrates is disposed so as to face each other and sandwich an electro-optical material;

a plurality of scanning lines;

a plurality of data lines that are provided so as to be substantially orthogonal to the plurality of scanning lines;

a plurality of common lines that are provided so as to be substantially parallel to the plurality of scanning lines;

a plurality of pixel electrodes that is each disposed at each of intersections of the plurality of scanning lines and each of the plurality of data lines;

a plurality of switching elements which each connects and disconnects one of the plurality of data lines to and from one of the plurality of pixel electrodes;

a plurality of storage capacitors which each has one end connected to respective one of the plurality of pixel electrodes and the other end connected to respective one of the plurality of common lines;

a common line driving circuit which supplies, to the plurality of common lines, a driving signal having a first potential or a second potential higher than the first potential;

a data line driving circuit which supplies each of image signals to each of the plurality of data lines at a potential higher than the first potential when the potential of the plurality of common lines is the first potential, and supplies each of the image signals to each of the plurality of data lines at a potential lower than the second potential when the potential of the plurality of common lines is the second potential; and a scanning line driving circuit which supplies, to each of the plurality of scanning lines, each of control signals for turning on and off each of the plurality of switching elements, the common line driving circuit including a driving signal supplying circuit for supplying the driving signal having the first potential or the second potential and a driving signal supplying switch for connecting and disconnecting the driving signal supplying circuit to and from the plurality of common lines, the method comprising:

turning on the driving signal supplying switch to apply the first potential to each of the plurality of common lines, of supplying each of control signals from the scanning line driving circuit to each of the plurality of scanning lines to turn on each of the plurality of switching elements, and of supplying each of image signals from the data line driving circuit to each of the plurality of data lines to write each of the plurality of image signals onto each of the plurality of pixel electrodes and each of the plurality of storage capacitors through each of the plurality of switching elements;

allowing the scanning line driving circuit to turn on each of the plurality of switching elements to apply a difference between the first potential of the plurality of common lines and the potential written onto each of the plurality of pixel electrodes to liquid crystal, and to hold the applied potential by each of the plurality of storage capacitors;

allowing the driving signal supplying circuit to raise the potential of the plurality of common lines from the first potential to the second potential;

allowing the scanning line driving circuit to turn on each of the plurality of switching elements to apply a difference between the second potential of the plurality of common lines and the potential written onto each of the plurality of pixel electrodes to the liquid crystal, and to hold the applied potential by each of the plurality of storage capacitors; and allowing the driving signal supplying circuit to lower the potential of the plurality of common lines from the second potential to the first potential, the steps being repeatedly performed, in the allowing of the driving signal supplying circuit to raise the potential, the driving signal supplying switch being temporarily turned off, the plurality of data lines and the plurality of common lines being connected to each other, and the driving signal supplying circuit raising the potential of each of the plurality of common lines from the first potential to the second potential, and in the allowing of the driving signal supplying circuit to lower the potential, the driving signal supplying switch being temporarily turned off, the plurality of data lines and the plurality of common lines are connected to each other, and the driving signal supplying circuit lowering the potential of each of the plurality of common lines from the second potential to the first potential.

9. The electro-optical device according to claim 1, wherein the driving signal supplying switch does not connect the plurality of common lines to any other circuit after disconnecting the driving signal supply circuit from the plurality of common lines.

10. The electro-optical device according to claim 7, wherein the driving signal supplying switch does not connect the plurality of common lines to any other circuit after disconnecting the driving signal supply circuit from the plurality of common lines.

* * * * *